US005297411A

United States Patent [19]

Scrimshaw

[11] Patent Number: 5,297,411

[45] Date of Patent: Mar. 29, 1994

[54] METHOD OF FORMING THREADED OPENING

[75] Inventor: Sydney I. Scrimshaw, Liverpool, United Kingdom

[73] Assignee: Eagle Precision Technologies Limited, Merseyside

[21] Appl. No.: 838,223

[22] PCT Filed: Jul. 20, 1990

[86] PCT No.: PCT/GB90/01123

§ 371 Date: Mar. 3, 1992

§ 102(e) Date: Mar. 3, 1992

[87] PCT Pub. No.: WO91/01188

PCT Pub. Date: Feb. 7, 1991

[30] Foreign Application Priority Data

Jul. 20, 1989 [GB] United Kingdom ..... 8916630

[51] Int. Cl.[5] ..... B21D 51/40

[52] U.S. Cl. ..... 72/70

[58] Field of Search ..... 220/288, 601; 72/70, 72/117, 120, 333, 335, 104, 118; 413/22, 23

[56] References Cited

U.S. PATENT DOCUMENTS

| | | | |
|---|---|---|---|
| 2,045,235 | 6/1936 | Newman | 72/117 |
| 2,257,234 | 9/1941 | Gould | 72/104 |
| 2,349,863 | 5/1944 | Hallberg | 80/6 |
| 2,387,990 | 10/1945 | Grosser | 220/601 |
| 2,460,721 | 1/1949 | Thompson | 29/148.2 |
| 2,493,933 | 1/1950 | Thompson | 29/34 |
| 2,625,065 | 1/1953 | Trishman | 80/6 |
| 2,645,954 | 7/1953 | Pfingston | 80/6 |
| 2,828,493 | 4/1958 | Koehler | 10/140 |
| 3,024,677 | 3/1962 | Greiman | 80/5.1 |
| 3,069,939 | 12/1962 | Koehler | 80/6 |
| 3,069,940 | 12/1962 | Koehler | 80/6 |
| 3,089,362 | 5/1963 | Hill | 80/6 |
| 3,177,691 | 4/1965 | Koehler | 72/67 |
| 3,938,374 | 2/1976 | Wadsworth | 72/104 |
| 4,096,723 | 6/1978 | Rhodes | 72/123 |
| 4,109,600 | 8/1978 | Post | 220/288 |
| 4,420,959 | 12/1983 | King | 72/113 |
| 4,426,870 | 1/1984 | Toropov | 72/118 |
| 4,462,235 | 7/1984 | King | 72/103 |
| 4,491,002 | 1/1985 | Toropov | 72/118 |
| 4,498,322 | 2/1985 | Toropov | 72/118 |
| 4,592,221 | 6/1986 | Krueger et al. | 72/104 |

FOREIGN PATENT DOCUMENTS

| | | |
|---|---|---|
| 3926821 | 2/1990 | Fed. Rep. of Germany . |
| 848027 | 10/1939 | France . |
| 2331394 | 11/1975 | France . |
| 2490119 | 3/1982 | France . |
| 1159656 | 7/1969 | United Kingdom . |

*Primary Examiner*—Lowell A. Larson

*Attorney, Agent, or Firm*—Nixon & Vanderhye

[57] ABSTRACT

A metal sheet is pierced, pressed and drawn to provide a raised cylindrical section having an axis and which section is partly closed by an annular flange. The flange is bent inwardly to enlarge the cylindrical opening by orbiting a tool in engagement with the flange about the axis and rolling the tool along the flange about a second axis offset from the cylindrical axis to enable enlargement and thinning of the flange. Subsequently, a peripherally screw-threaded cylindrical roller of a diameter less than the diameter of the flange is continuously rolled about the flange in orbital relationship with flange cylinder axis until the surface is deformed into a complementary screw configuration.

11 Claims, 2 Drawing Sheets

METHOD OF FORMING THREADED OPENING

This invention relates to metal deformation and particularly but not exclusively to a method of forming a cylindrical, internally threaded opening in an end wall of a metal, preferably mild steel, container drum.

It is known to provide cylindrical openings in the end walls of container drums by fitting a pre-fabricated insert into the end wall. This is disadvantageous because of the additional costs involved in pre-fabricating and fitting the insert. It is therefore one object of the present invention to provide a method of forming an integral cylindrical opening in the container drum end wall and forming an internal screw-thread on said opening. More generally, it is an object of the present invention to provide a method of forming a screw thread on any internal cylindrical surface.

According to a first aspect of the present invention there is provided a method of forming a cylindrical opening in a metal sheet, for example a container drum end wall, comprising piercing, pressing and drawing the metal sheet to provide a raised cylindrical section partly closed at one end by an annular flange, and bending the flange into the cylindrical section while rolling the flange so as to permit the requisite enlargement thereof.

According to a second aspect of the present invention there is provided a method of forming a screw-thread on an internal cylindrical surface, for example a cylindrical opening as produced by the method of the first aspect of the invention, comprising rolling a peripherally screw-threaded roller continuously over said surface in orbital relationship with the cylinder axis until the surface is deformed into a complementary screw configuration.

The invention will now be further described by way of example only with reference to the accompanying drawings in which.

Figure 1:
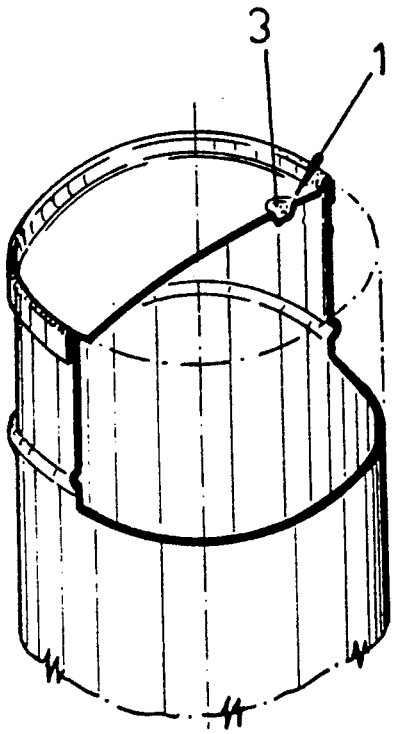
FIG. 1 is a partly cut-away view of one end of a container drum with the end wall in section through the closure opening.
Figure 2:
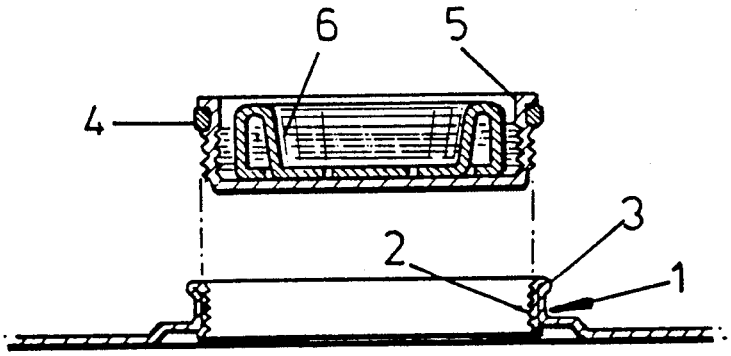
FIG. 2 is a detail of FIG. 1 to an enlarged scale.

Referring now to the drawings, FIG. 1 shows part of a cylindrical container drum made of mild steel having an end wall provided with a closure opening further illustrated in FIG. 2 as comprising a raised cylindrical section 1 of double thickness with a screw-thread 2 on the cylindrical inner surface of the inner metal skin. The outer end of the cylindrical section is thickened to provide a sealing surface 3 which is engaged by a sealing ring 4 of a conventional externally threaded bung 5 having an internal handle 6.

Figure 3:
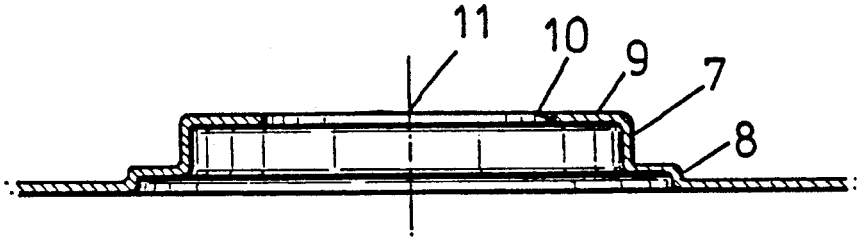
FIGS. 3 to 6 illustrate successive stages in the manufacture of the closure opening shown in FIG. 2.
Figure 4:
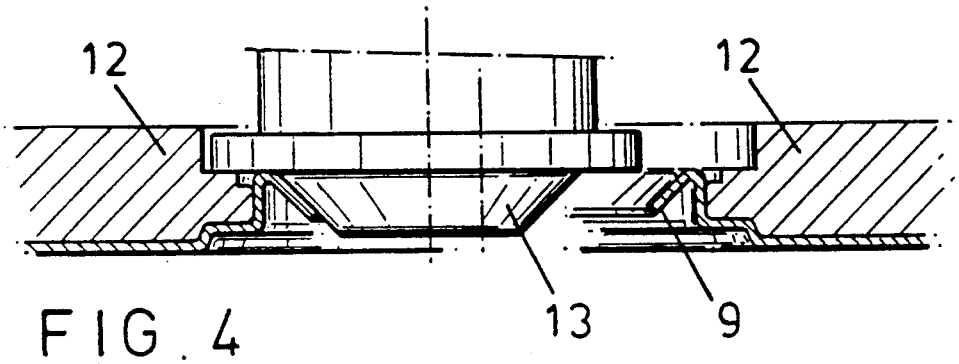
Figure 5:
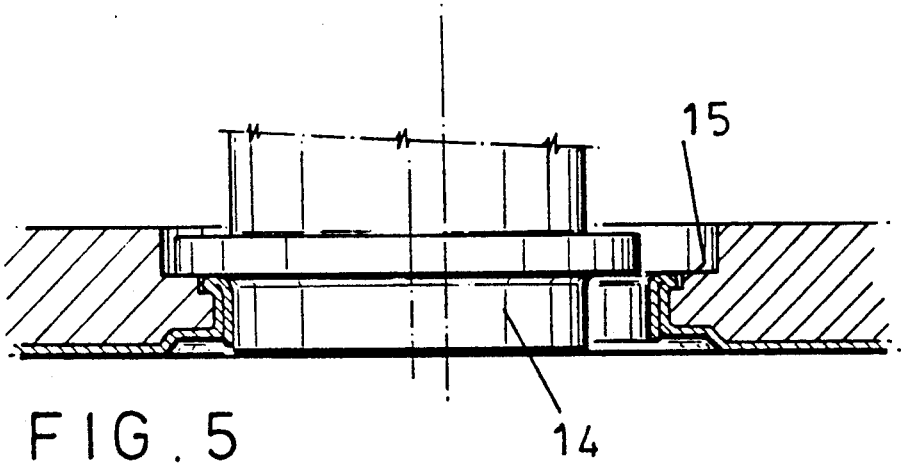
Figure 6:
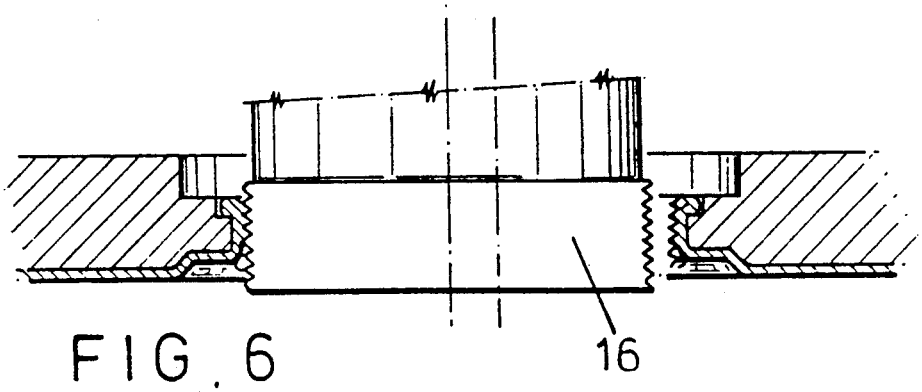

The closure opening illustrated in FIG. 2 is made by first piercing, pressing and drawing the metal sheet constituted by the drum end wall (prior to fixing to the drum end in conventional manner) to form a cylindrical section 7 raised out of the plane of the end wall by a step 8 and terminating at its outer end in an annular flange 9 which partly closes the cylindrical section leaving a circular opening 10 around a central axis 11 (FIG. 3).

The raised cylindrical section 7 is then surrounded by clamping supports 12 and a tool 13 is progressively introduced into the opening 10 so as to bend the flange 9 inwardly. Such deformation of the flange 9 requires a corresponding enlargement of the opening 10 which cannot be achieved without extension of the flange 9 along its circumferential dimension. Such extension is achieved by orbiting the tool 13 about the axis 11 while simultaneously rolling the frusto-conical tool surface on the flange 9 to achieve the necessary thinning of the metal in this region. When the flange 9 has been bent inwardly to an extent conforming to the shape of the tool 13, the tool 13 is replaced by a tool 14 which has a cylindrical working surface which, using the same rolling action as the tool 13, completes the inward deformation of the flange 9 and the attendant enlargement of the hole 10. The tool 14 also creates the shoulder 3 by pressing metal into a circular recess 15 in the clamping segments 12.

The cylindrical section 1 is then completed by using a thread forming tool 16 which has an orbiting and rolling action like tool 14 but in this case is provided with a thread formation on its outer cylindrical periphery, the action of the tool 16 serving to impress said thread formation onto the internal surface of the cylindrical section.

When internal thread forming, it is necessary to adjust for pitch error originating from the difference in peripheral length between the outer tube diameter being formed and the thread rolling tool diameter.

This difference, when the tool rolls on the component without slipping, causes a relative angular positional displacement of the two thread forms (forming and generated).

Compensation for this difference may be accomplished by axial displacement of the tool amounting to the pitch of the thread times the ratio of the two diameters.

As the depth of thread form increases during the rolling process this ratio varies with the instantaneous root diameter of the generated thread form.

The axial displacement of the forming tool may be achieved by allowing the tool to float freely or by providing an incremental movement of the tool spindle relative to tool rotation.

Alternatively, the accumulative effects may be avoided by alternating the direction of rotation of the forming tool after each full revolution of the tool spindle.

It will be appreciated that the invention has wider application than suggested by the above description. For example, a similar threaded closure may be formed with a single thickness of metal in which case the preliminary piercing, pressing and drawing operation omits the flange 9 rendering the bending stages using tools 13 and 14 unnecessary, the thread forming tool 16 being used for forming the thread in the cylindrical section 7. The invention is not confined to the formation of cylindrical closure openings for end walls of container drums and the threading operation, for example, has wide application in relation to other cylindrical articles, e.g. conduit sections, which require an internally threaded end section.

I claim:

1. A method of forming a cylindrical opening in a metal sheet, comprising piercing, pressing and drawing the metal sheet to provide a raised cylindrical section having an axis and partly closed at one end by an annular flange, and bending the flange axially inwardly to enlarge said cylindrical opening by (i) orbiting a tool in engagement with said flange about said cylindrical section axis and (ii) rolling the tool along the flange about a second axis offset from said cylindrical section axis to enable enlargement and thinning of said flange.

2. A method according to claim 1 wherein the metal sheet is a container drum end wall.

3. A method according to claim 1 including externally supporting the raised cylindrical section during bending, orbiting and rolling.

4. A method according to claim 1 including deforming an outer end of the cylindrical section radially outwardly during bending, orbiting and rolling to provide a sealing surface for engagement by a sealing ring of a bung.

5. A method according to claim including providing the inwardly bent flange with an internal screw-thread by continuously rolling a peripherally screw-threaded cylindrical roller of a diameter less than the diameter of the flange over the flange surface in orbital relationship with the flange cylinder axis until the surface is deformed into a complementary screw configuration.

6. A method according to claim 5 including enabling the screw-threaded roller to move axially to compensate for the difference in pitch between forming and generated threads on the threaded roller and flange, respectively.

7. A method according to claim 5 including positively displacing the screw-threaded roller in an axial direction to compensate for the difference in pitch between forming and generating threads on the threaded roller and the flange, respectively.

8. A method according to claim 1 including externally supporting the raised cylindrical section during bending, orbiting and rolling and deforming an outer end of the cylindrical section radially outwardly during bending, orbiting and rolling to provide a sealing surface for engagement by a sealing ring of a bung.

9. A method according to claim 1, including providing the inwardly bent flange with an internal screw-thread by continuously rolling a peripherally screw-threaded cylindrical roller of diameter less than the diameter of the flange over the flange surface in orbital relationship with the flange cylinder axis until the surface is deformed into a complementary screw configuration.

10. A method according to claim 9 including enabling the screw-threaded roller to move axially to compensate for the difference in pitch between forming and generated threads on the threaded roller and flange, respectively.

11. A method according to claim 9 including positively displacing the screw-threaded roller in an axial direction to compensate for the difference in pitch between forming and generating threads on the threaded roller and the flange, respectively.

* * * * *